United States Patent [19]

Ennslin et al.

[11] 4,039,811

[45] Aug. 2, 1977

[54] METHOD OF OPERATING AND POWER SUPPLY FOR X-RAY TUBES

[75] Inventors: Frieder H. Ennslin; Richard J. Buck, both of Rochester, N.Y.

[73] Assignee: Sybron Corporation, Rochester, N.Y.

[21] Appl. No.: 635,068

[22] Filed: Nov. 25, 1975

Related U.S. Application Data

[63] Continuation-in-part of Ser. No. 560,446, March 21, 1975, abandoned, which is a continuation of Ser. No. 390,929, Aug. 23, 1973, abandoned.

[51] Int. Cl.[2] ..... H05G 1/30

[52] U.S. Cl. ..... 250/409; 250/402

[58] Field of Search ..... 250/401, 402, 409, 421, 250/322; 323/6, 45

[56] References Cited

U.S. PATENT DOCUMENTS

| | | | |
|---|---|---|---|
| 2,810,838 | 10/1957 | Clapp et al. | 250/409 |
| 3,284,631 | 11/1966 | Splain | 250/401 |
| 3,325,645 | 6/1967 | Splain | 250/409 |
| 3,521,067 | 7/1970 | Splain | 250/409 |
| 3,543,030 | 11/1970 | Splain | 250/421 |
| 3,567,940 | 3/1971 | Lambert | 250/409 |
| 3,567,995 | 3/1971 | Lauritzen et al. | 250/421 |
| 3,792,267 | 2/1974 | Westerkowsky | 250/322 |
| 3,894,235 | 7/1975 | Franke | 250/409 |
| 3,936,721 | 2/1976 | Butterworth | 323/6 |
| 3,944,909 | 3/1976 | Reymond | 323/45 |

*Primary Examiner*—Alfred E. Smith
*Assistant Examiner*—B. C. Anderson
*Attorney, Agent, or Firm*—Theodore B. Roessel; J. Stephen Yeo

[57] ABSTRACT

A power supply and timing circuit for an X-ray tube capable of maintaining constant X-ray exposure values and stable peak plate voltage despite relatively large variations in the voltage of the source from which the power supply is fed. The cathode-to-plate current in the X-ray tube is varied responsively to changes in the voltage of the source, thereby varying the load on the high voltage transformer and holding its output voltage at a constant value despite changes in the source voltage. Changes in the cathode-to-plate current may be compensated for by the use of a milliampere-second integrator to time the exposure.

13 Claims, 7 Drawing Figures

METHOD OF OPERATING AND POWER SUPPLY FOR X-RAY TUBES

CROSS REFERENCE TO RELATED APPLICATIONS

This application is a continuation in part of Ser. No. 560,446, filed Mar. 21, 1975, now abandoned, which is a continuation of Ser. No. 390, 929, filed Aug. 23, 1973, now abandoned, all being of the same inventorship.

BACKGROUND OF THE INVENTION

This invention relates to a novel method of operating X-ray tubes, and a novel power supply for carrying out the method.

A major problem in roentgenography is radiation output variation especially in instruments that take their power from the conventional 115 or 230 volt line from a central power station. The voltage at a local outlet on the conventional line often varies substantially from its nominal value such as, for example, responsively to changes in the load placed on the line at other local outlets. Unless some sort of regulation is provided, the radiation output of an X-ray tube energized from the conventional line varies to an intolerable degree from its radiation output when the line voltage is at its nominal value.

Relatively high voltages, ranging upwardly from fifty kilovolts, are used for energizing X-ray tubes, and, for reasons of cost, it is not always desirable to provide regulated DC power supplies. Instead, an alternating voltage is usually applied between the cathode and the plate through a high voltage transformer, the primary winding of which is connected to the conventional power line through some sort of energizing circuitry. The output of the high voltage transformer is sometimes fed through a full wave rectifier, but often without filtering and without high voltage regulation.

SUMMARY OF THE INVENTION

A power supply and method for an X-ray tube capable of maintaining X-ray exposure values and the peak plate voltage highly stable despite relatively large variations in the voltage of the source from which the power supply is fed. High voltage is applied across the cathode and plate of the tube by means of a loosely coupled transformer. The cathode-to-plate current in the X-ray tube is varied responsively to changes in the voltage of the source, thereby varying the load on the loosely coupled transformer and changing the coupling coefficient of the transformer holding its peak output voltage at a constant value despite changes in the source voltage.

BRIEF DESCRIPTION OF THE DRAWINGS

Representative embodiments of the invention will now be described in conjunction with the drawings, wherein.

DETAILED DESCRIPTION

Figure 1:
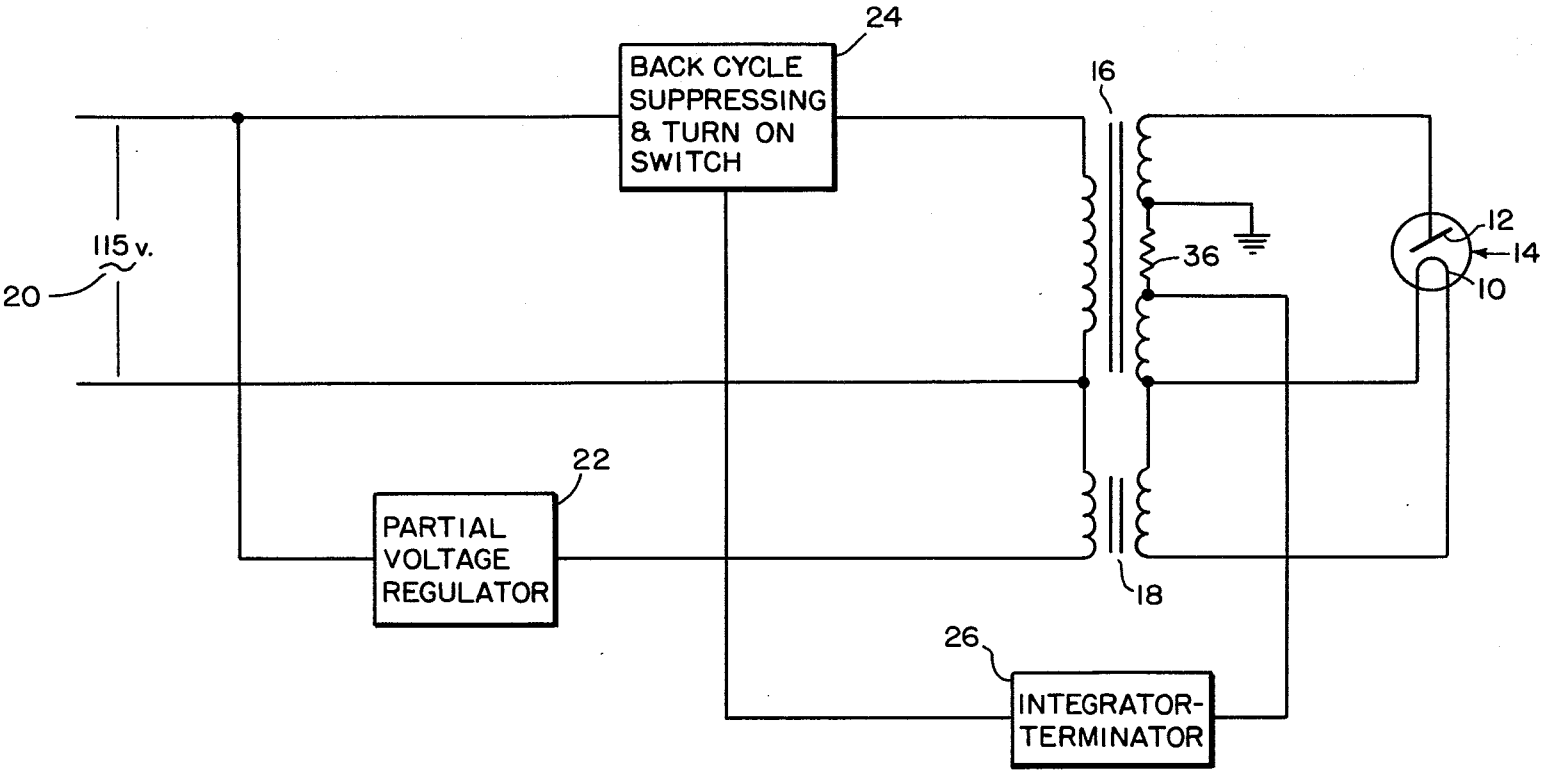
FIG. 1 is a simplified schematic diagram, largely in block form, of a power supply and timer according to the invention using thermionic control.

Referring first to FIG. 1 a first embodiment of the invention is seen. The cathode 10, and plate 12 of an X-ray tube 14 are connected to the output terminals of the secondary winding of a conventional high voltage transformer 16. As shown, the tube 14 is of the conventional Coolidge type, and its cathode 10 being a filament that emits electrons when it is heated by current passed through it from a low voltage transformer 18. Plate 12 is also called a anode.

The primary winding of the low voltage transformer 18 is connected to the power line 20 through a regulating circuit 22, being in the first embodiment a partial voltage regulator, that reduces the variations in the voltage applied to the primary winding of the filament transformer 18 relative to the variations that occur on the line 20 by a factor chosen to maintain a constant tube voltage as will be explained below. The reduction factor may vary over a relatively wide range, from less than 50% for certain types of X-ray tubes to more than 90% for others.

Figure 3:
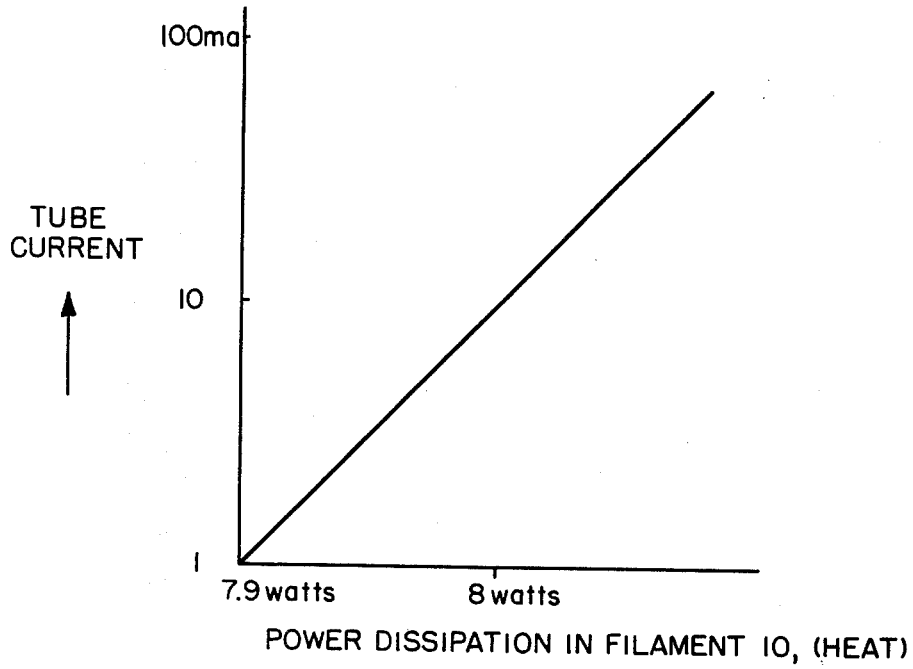
FIG. 3 illustrates the relation between tube current and filament temperature.

The purpose of the invention is to maintain a substantially constant tube voltage independent of variations in the line voltage 20. The radiation output of tube 14 is determined by the plate current and the square of the high voltage emission current emitting from filament 10 and hitting plate 12 is a function of both the filament temperature and the voltage across the tube induced by transformer 16. Of these two factors the filament temperature has the greatest effect on plate current. FIG. 3 is a curve illustrating how the tube plate current is a function of the filament temperature. Not to be confused is the plate current and the current used to heat the filament.

Fortunately, the filament temperature is easily regulated. The filament is heated by the output voltage of transformer 18 which is regulated by a voltage regulator 22. In the prior art, 100 percent filament regulation was the desired goal while in the first embodiment only partial regulator is desired.

Figure 4:
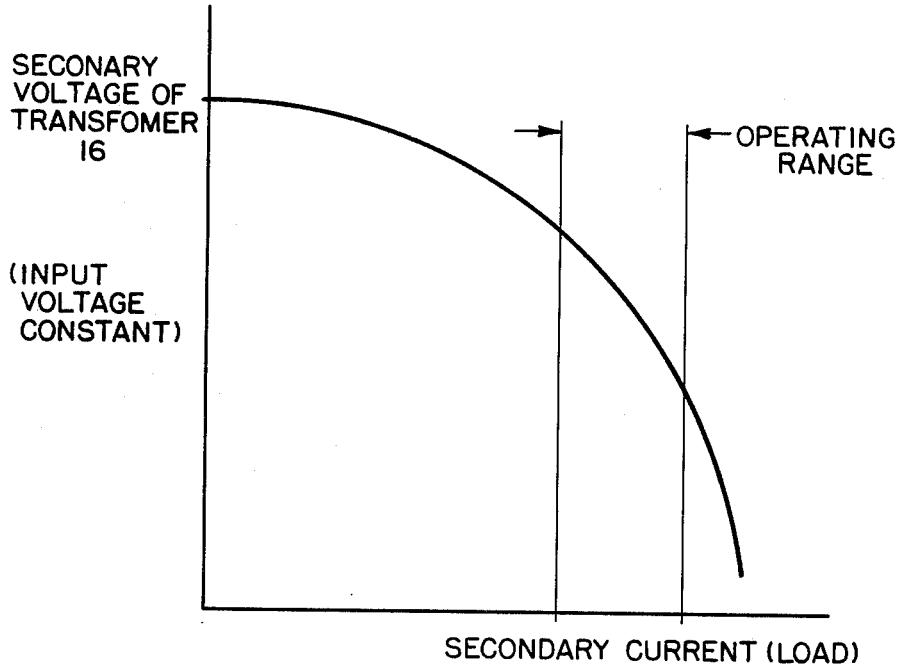
FIG. 4 shows the effect of loading on a loosely coupled transformer.

Variations in line voltage 20 can also effect the output of high voltage transformer 16. Transformer 16 has a high voltage output in excess of 50 kv. Conventional high voltage transformers such as 16 usually have loose couplings between the primary and secondary windings. A known property of such loose coupling transformers is that the coupled coefficient between the coils is not a constant but is dependent upon the output load (in our application, the output load is tube 14). With higher current levels, the leakage flux increases and the coupling coefficient decreases causing a reduction in output voltage if the input voltage is held constant. This effect is cummulative with resistive losses in the transformer. The relationship of output voltage and load is indicated by FIG. 4. Note that if the input voltage is held constant, the secondary output voltage will vary with load. That is to say the output/input voltage ratio will decrease with increased plate current. Both embodiments of the instant invention take advantage of this property which has heretofore been considered undesirable.

Consider again, the circuit of FIG. 1. Let us assume there is a rise in line voltage 20 and the filament voltage is only partially regulated. Both the filament and the input of high voltage transformer 16 will have increased voltages. The effect of the increased voltage on the filament is to increase tube plate current as shown in FIG. 3. This increase in plate current loads transformer 16 causing a reduction in the output/input voltage ratio of the transformer 16. As a result of the increase load, the tube voltage remains substantially constant (regardless of moderate variations in the line voltage). It is helpful to note that had the load not been adjusted the output/input voltage ratio would have remained about constant and the tube voltage would have increased.

Therefore, as a feature of the first embodiment, the filament voltage is only partially regulated by regulator 22. It is necessary that the degree of filament variation is chosen so the effects of transformer 16 and filament 10 balance so as to maintain a tube plate current sufficient to load the transformer 16 changing its output/input voltage ratio inversely with line voltage so as to maintain a relatively constant tube voltage. The selection of the amount of filament regulation is determined upon tube characteristics and properties of the transformer. For typical Coolidge type tube and a high voltage transformer, such as to be described hereafter, 90% of the filament regulation is correct.

Figure 5:
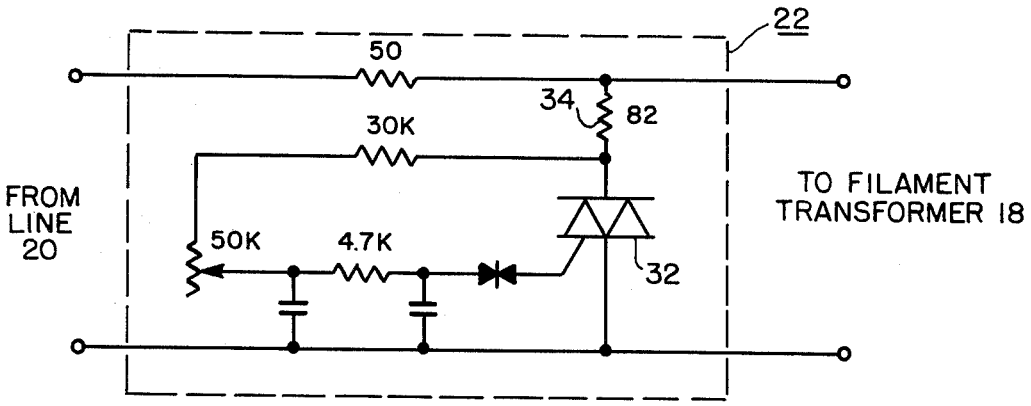
FIG. 5 is a detailed schematic of the partial voltage regulator of FIG. 1.
Figure 6:
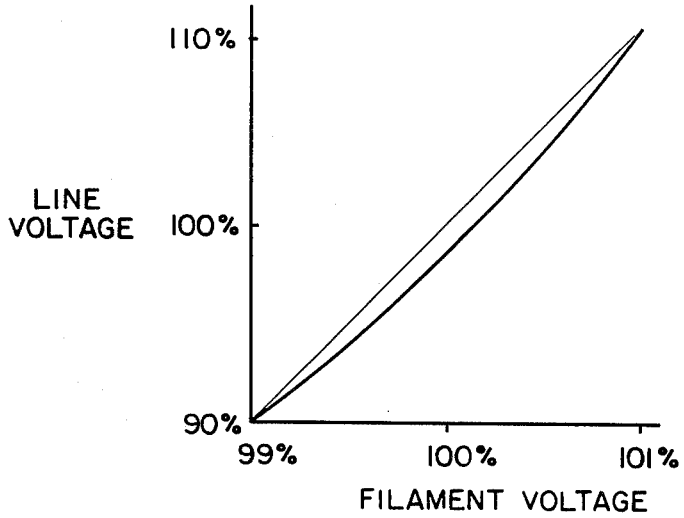
FIG. 6 is a curve showing the change in filament voltage verses line voltage with the partial voltage regulator.

FIG. 5 is a schematic of a voltage regulator of the phased controlled type suitable to be interposed between the line 20 and the input of filament transformer 18 as regulator 22. Typical circuit values are given in the drawing. The circuit detail is well known and so will only be described briefly. Triac 32 and resistor 34 are shunted across the primary winding of the transformer 18. A bias circuit provides a rectified sample for line voltage which is applied to the gate of triac 32. Upon sufficient bias, triac 32 will conduct reducing the percentage of line voltage variation across transformer 18 and the corresponding filament voltage. Selection of resistive values will determine the amount of regulation. FIG. 6 is a curve, illustrating that the percentage changing in filament voltage versus the percentage change in line voltage. In this example, a 10% change in line voltage will give only a 1% change in the filament voltage equal to 90% regulation.

The output of the low voltage transformer 18 is purposely allowed to vary significantly in direct response to variations in the voltage on the line 20. This is in contrast with many X-ray tube control circuits heretofore used or proposed, which include means for keeping the current through the cathode constant thereby to maintain the temperature and emission of the cathode at constant values during an exposure within very close limits.

It has been found that it is possible to adjust the proportionality of the partial voltage regulator 22 so that the changes in the emission of the cathode 10 affect the load on the high voltage transformer to an extent to compensate almost exactly for variations of the line voltage. For example, if the voltage across the line 20 drops from its nominal value, the cathode 10 rapidly cools a bit, and the emission current falls just enough to reduce the load on the high voltage transformer so that its output voltage remains the same as it was before the drop in the line voltage. Conversely, an increase in the line voltage results in greater emission and an increase in the load on the high voltage transformer, compensating for the effect of the increase in the line voltage.

Figure 7:
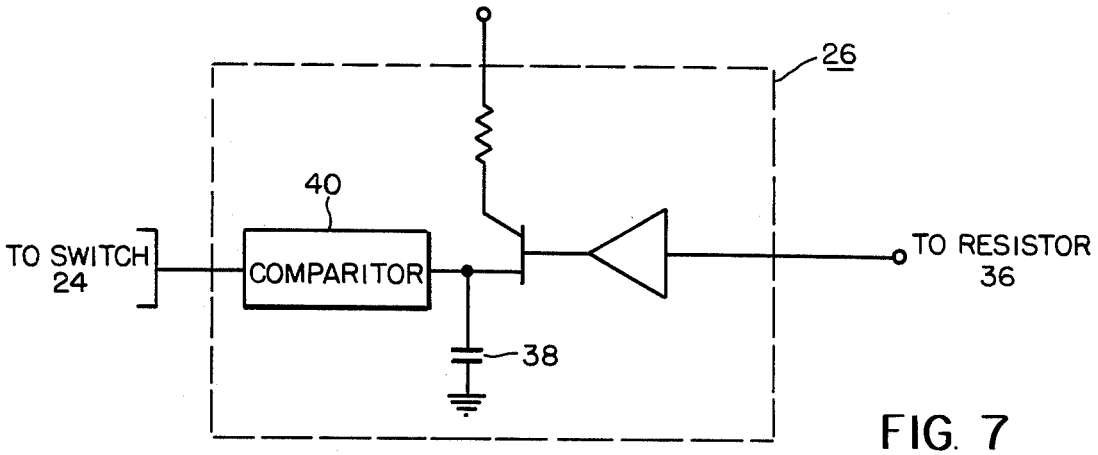
FIG. 7 is a schematic of the integrator-terminator of FIGS. 1 and 2.

Although the tube voltage is now constant, the changes in tube current caused by the residual filament variation will affect the amount of X-ray variation. The variation in the emission current maybe compensated by use of a known milliamp-second integrator terminator 26 which turns off the high voltage supplied to the tube when the desired dosage is reached. A suitable circuit is shown in FIG. 7. A resistor in series with tube develops a signal proportional to the tube current. It is to be realized that the current has a half way rectified wave form having pulses of equal time duration. The peak amplitude of each pulse is stored by capacitor 38 which results in a step wave form. When the voltage on the capacitor reaches a preselected value representing the desired X-ray dosage, a voltage comparator or equivalent circuit such as a SCR gate triggers electrical switch 24 to the off position disconnecting the high voltage supply to the tube.

For best results, it is desirable to preheat the filament prior to the application of high voltage to the tube. This is to prevent the output of transformer 16 as applied to tube 14 to overshoot or undershoot due to incorrect tube emission current. Accordingly, known delay means, not shown, may be incorporated in the circuit so that the filament is preheated for a predetermined time before switch 24 is turned on. The details of delay circuitry are well-known and is not considered part of this invention.

Figure 2:
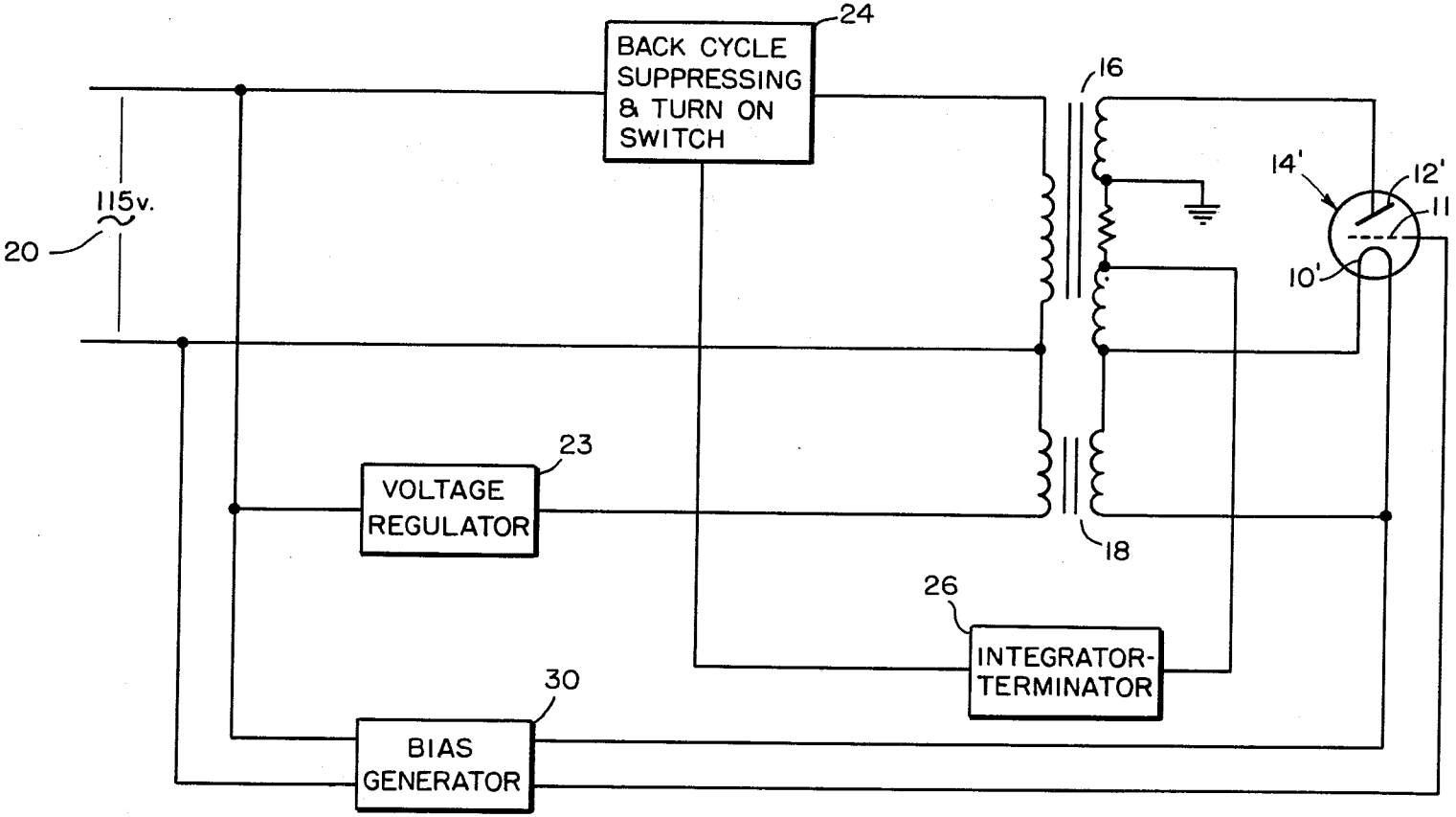
FIG. 2 is a diagram generally similar to the diagram of FIG. 1, but showing an arrangement according to the invention for bias control.

The second embodiment as shown in FIG. 2 illustrates the use of bias control to vary the plate current. The tube 14' includes a control grid 11 adjacent to the cathode 10'. The heating current applied to the cathode 10' is regulated by a regulator 23, and the plate 12' is connected to the output of the conventional high voltage transformer 16. Unlike the first embodiment but in keeping with the teaching of the prior art, the filament voltage is to be 100% regulated. Instead of having the filament temperature vary tube plate current, a grid bias generator 30 is connected between the line 20 at its input and the grid 11 and cathode 10 at its output. The bias generator 30 may include a simple amplifier which senses changes in line voltage and adjusts the voltage between grid 11 and the cathode 10' so as to vary the plate current which is the load of transformer 16. With proper gain, easily determinable for the individual components, the load may be varied to maintain a constant high voltage across tube 14. Integrator 26 is used to compensate for variations in tube current as in the first embodiment.

In this embodiment of the invention an ON-OFF exposure control is preferably built into the bias generator 30 so that the cathode may be continuously heated and kept at ready, and the plate voltage kept always ON. Full control of the exposure is thus concentrated in the bias generator 30 and the integrator-terminator 26.

Both embodiments use a conventional high voltage transformer (16) which has a load dependent coupling coefficient. The design details of a suitable transformer follows.

A rectangle core having an outline of approximately 8.7 inches by 4.5 inches is constructed of langes of 12 MIC Silectron "C" (Arnold Eng. Co AA1617). The core may be envised as having two long arms and two short arms joined together to form a rectangle. Each arm has a 1.3 inch square cross section.

Wound about one of the long arms is the primary coil consisting of 240 times of 14 magnet wire. An insulating tube surrounds the primary and the secondary coil is wound about the tube. Two series windings of approximately 75,000 turns of No. 40 magnet wire each is used. Loose coupling is inherent in this type of transformer.

It will be understood that many details of a conventional nature have been omitted from the drawing and from this description. It is contemplated, for example, to provide for selection of any of several different voltages for energizing the high voltage transformer 16 to enable energization of the tube 14 at any of several different kilovolt values. Also, the terminator 26 may include a selector device to enable the operator to select any of several different exposure values.

The first embodiment utilizing thermionic control, is the presently preferred embodiment from a commercial point of view, because most X-ray tubes in commercial use do not have control grids, and because the embodiment is very simple, relatively inexpensive, and requires a minimum of circuitry.

The alternative embodiment, utilizing bias control, is preferred from a technological viewpoint because its response is much faster than that of the terminonic control, and because the control grid may at the same time be used to start and stop the generation of X-rays, allowing the cathode to be heated continuously and the plate voltage to be kept always ON, thereby avoiding problems related to heat-up times and thermal lag, and facilitating the timing of the start of each exposure at a predetermined point of the cycle of the voltage of the source.

The invention arose in connection with efforts to improve reproducibility of X-ray exposures in dental X-ray equipment in response to recently proposed standards more stringent than the standards heretofore widely regarded as acceptable. Its use is not limited, however, to dental and medical X-ray apparatus, but is expected to be highly advantageous in all forms of roentgenography where exposure values are of concern. In dental and medical work, for example, the exposure of patients to radiation is minimized by the practice of the invention, because only a single exposure is required for each picture - there is no need to make a second picture because the first one was not properly exposed. In other kinds of work, the savings in cost of materials and time are believed to be of value.

What is claimed is:

1. Method of operating an X-ray tube of the kind that is energized from a conventional alternating current power source through a load responsive high voltage transformer comprising the steps of: varying the plate current in response to changes in the voltage of the source, thereby the chaning the electrical load of the transformer to a degree that the output voltage of said transformer remains substantially constant independent of changes in the voltage across its input.

2. Method according to claim 1 wherein the plate current is varied by varying the temperature of the cathode.

3. Method according to claim 1 wherein the X-ray tube is of the Coolidge type, and the plate current is varied by varying the filament current passed through the cathode to heat it.

4. Method according to claim 3 wherein the changes in the current passed through the cathode to heat it, taken as a fraction of the current, are limited to about 10% to 50% of the fractional changes of the voltage of the source.

5. Method according to claim 1, wherein the X-ray tube is of the kind having an electrode capable of functioning as a control grid, and the plate current is varied by varying the voltage between said electrode and the cathode.

6. Method according to claim 5 including the steps of turning the X-ray emission of the tube ON and OFF by varying the voltage between said electrode and cathode.

7. Apparatus for connection between an X-ray tube and a source of alternating current, the voltage of which may vary significantly from a nominal value, for providing and regulating the high voltage for the tube comprising:

a. a loosely coupled load responsive high voltage transformer having a secondary winding to be connected across the plate and the cathode of the tube for supplying the plate current, b. means for varying the plate current of the tube in response to changes in the voltage of the source of current loading said transformer, so that the output voltage of said transformer remains substantially constant.

8. Apparatus according to claim 7 wherein said means for varying the plate current comprises means for varying the temperature of the cathode of the tube in fractional response to variation in the source voltage.

9. Apparatus according to claim 8 wherein the cathode of the tube is a filament and heated by electric current passed through it, and said varying means includes a partial voltage regulator connected between the source and the cathode for reducing the voltage variation that appear across the cathode relative to the variation that would appear there without regulation.

10. Apparatus according to claim 7 including a control grid within the X-ray tube between the cathode and anode thereof, and wherein said varying means comprises means for varying the voltage between the control grid and the cathode in direct proportion and in response to changes of the voltage of the source of current.

11. In combination with an X-ray tube having a plate and a cathode, a power supply for energization by line voltage and for providing a stabilized high voltage to said tube and comprising:

a high voltage transformer having a primary coil and a secondary coil and characterized by having an output/input voltage ratio inversely dependent upon the load of said transformer;

said primary coil energized by said line voltage;

said secondary coil connected to said anode and cathode for applying high voltage thereto;

current control means for controlling the current flowing between said plate and cathode in fractional response to variations in the line voltage thereby affecting the load on said transformer so that the high voltage between said anode and cathode is substantially constant.

12. A power supply as defined in claim 11 wherein said cathode is a filament heated in response to an applied low voltage and said current control means is a voltage regulator interposed between said line voltage and said filament for partially regulating said low voltage to a degree that said filament emits current to said plate in response to the line voltage thereby varying the load on said high voltage transformer thereby changing the output/input voltage ratio so that the high voltage between said filament and said plate is substantially constant.

13. The power supply of claim 11 wherein said tube includes a control grid and said current control means is a bias generator interposed between said grid and said supply voltage for applying a bias voltage to said grid in response to line voltage.

* * * * *